United States Patent [19]

Weidner

[11] 3,999,831

[45] Dec. 28, 1976

[54] LOCKING MEMBER FOR SECURING A CONTACT PLATE IN THE HOUSING OF AN ELECTRIC SWITCHING APPARATUS

[75] Inventor: Georg Weidner, Amberg, Germany

[73] Assignee: Siemens Aktiengesellschaft, Munich, Germany

[22] Filed: Dec. 8, 1975

[21] Appl. No.: 638,660

[30] Foreign Application Priority Data

Dec. 12, 1974 Germany ..... 2458870

[52] U.S. Cl. ..... 339/220 R; 151/41.74

[51] Int. Cl.[2] ..... A45C 13/18; H01R 9/08

[58] Field of Search ..... 339/217 R, 220 R; 151/41.74

[56] References Cited

UNITED STATES PATENTS

| | | | |
|---|---|---|---|
| 2,235,780 | 3/1941 | Wagstaff | 339/220 R |
| 2,715,715 | 8/1955 | Bentley | 339/217 R |

*Primary Examiner*—Roy Lake
*Assistant Examiner*—Craig R. Feinberg
*Attorney, Agent, or Firm*—Kenyon & Kenyon Reilly Carr & Chapin

[57] ABSTRACT

An improved locking member for the housing of an electric switching apparatus including a contact plate having a threaded aperture, and a screw-type electrical contact disposed in the aperture. The housing has an elongated slit disposed therein transverse to the direction of insertion of the contact plate into the housing which opens into the interior thereof adjacent the plate and the contact. The locking member is inserted through the slit into the housing for securing the contact plate therein. The improvement of the invention comprises the locking member comprising a planar sheet member having a recess disposed therein and a projection member integrally formed with the sheet member extending into the recess in the plane of the sheet member from one side thereof. The projection member is supported in the housing below the aperture in the contact plate so that it is engaged by the screw contact during insertion thereof into the contact plate and is bent downwardly from the plane of the sheet member below the housing slit. Withdrawal of the sheet member from the slit and the housing is thereby prevented.

3 Claims, 3 Drawing Figures

LOCKING MEMBER FOR SECURING A CONTACT PLATE IN THE HOUSING OF AN ELECTRIC SWITCHING APPARATUS

BACKGROUND OF THE INVENTION

1. Field of the Invention

The present invention relates generally to electrical switching apparatus, and in particular to an improved arrangement for securing a contact plate and screw-type electrical contact in the housing of such an apparatus.

2. Description of the Prior Art

Arrangements for securing electrical contacts and contact plates of the above-described type in the housing of an electric switching apparatus by means of a locking member disposed transversely with respect to the direction of insertion of the contact plate and contact into the housing of the apparatus are generally known in the art. In one known arrangement of this type, a cutout having a T-shaped cross section is provided in a wall of the apparatus housing. A contact plate having a tapered middle portion is inserted through the upper part, i.e., bar, of the T-shape cutout, and the tapered middle portion is then slid downwardly into the vertical part of the T-shape of the cutout and is prevented from moving upwardly back to the upper part of the T-shape by means of a leaf spring disposed in the bar portion of the T-shape. A slot is provided on the side surface of the contact plate facing the leaf spring, and the latter is disposed in this slot and is thereby secured against displacement. The disadvantage of this arrangement, however, is that even if the leaf spring is made relatively thick, a secure seating of the contact plate is not attainable and it is possible for the leaf spring to slide out of the slot during operation of the equipment. To avoid this problem, the leaf spring may be provided with an extension which is simultaneously used as a pressure element for the line to be clamped in the apparatus which contains an aperture through which the clamping screw is disposed. Although it is thus assured that the leaf spring is not lost in the housing when the contact is inserted into the contact plate, it is still possible for the contact plate to loosen, particularly if it is used as a switch contact, and the leaf spring can slide out of the housing slot if the screw contact is removed.

SUMMARY OF THE INVENTION

It is therefore an object of the present invention to provide an improved locking member for the housing of an electric switching apparatus of the type using a contact plate having a threaded aperture and a screw-type electrical contact disposed therein, which overcomes the aforementioned disadvantages of heretofore known arrangements, which securely retains a contact plate within the housing of such an apparatus, and from which the locking member securing the contact plate cannot be removed without separate tools even if the screw-contact is removed from the contact plate.

These and other objects of the invention are achieved in the housing of an electric switching apparatus including a contact plate having a threaded aperture and a screw-type electrical contact disposed in the aperture. The housing of the apparatus has an elongated slit disposed therein transversely with respect to the direction of insertion of the contact plate into the housing which opens into the interior of the housing adjacent the plate and the contact. A locking member is inserted into the housing through the slit for securing the contact plate therein. The improvement of the invention comprises the locking member comprising a planar sheet member having a recess disposed therein and a projection member integrally formed from the sheet member. The projection member extends into the recess in the plane of the sheet member from one side thereof. The sheet member is supported by slots provided in the apparatus housing and the projection member is disposed below the aperture in the contact plate of the apparatus so that it is engaged by the screw contact during insertion thereof into the contact plate. The projection member is thus bent downwardly by the screw contact from the plane of the sheet member below the slit provided in the housing wall. Withdrawal of the sheet member from the slit and the housing is thereby prevented.

The above-described arrangement secures the locking member against displacement without the performance of an additional operation other than the insertion of the screw contact and without the use of additional parts. A mounting for the contact plate is thus provided, and securement of the locking member is achieved automatically when the screw contact is inserted in the contact plate. It is preferable that the projection member provided in the sheet member be stamped clear and have dimensions which are sufficient to cover, either partially or wholly, the aperture in the contact plate which receives the screw contact. The inventive construction assures that the locking member is not weakened at its outer portions at which the force exerted thereon by the contact plate is concentrated during the insertion of the screw contact into the contact plate. The projection can then be shaped so that, when bent, it engages part of the wall of the housing and functions as a brace. If required, the locking member can be removed from the housing and slit by bending the projection member back into the plane of the sheet member by means of a suitable tool while the contact screw is removed. This cannot be done, however, arbitrarily often. To facilitate such removal of the locking member, it is preferable to place the contact plate in a cutout in the housing which is open from the bottom side thereof.

These and other features of the invention described herein will be described in greater detail in the following detailed description.

BRIEF DESCRIPTION OF THE DRAWINGS

In the drawings, wherein similar reference numerals denote similar elements throughout the several views thereof.

DETAILED DESCRIPTION

Figure 1:
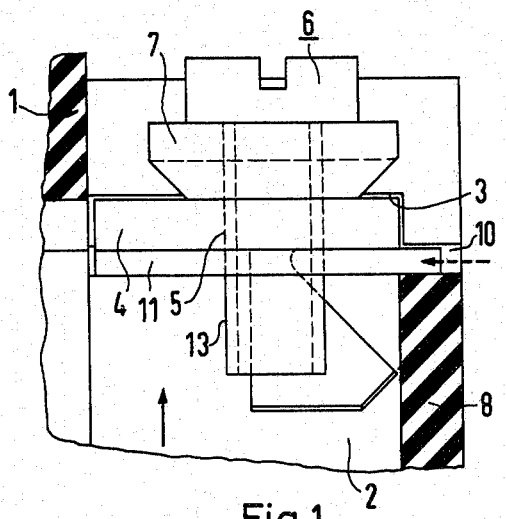
FIG. 1 is a partial, cross-sectional side view of the housing of an electric switching apparatus including an improved locking member constructed according to the invention.
Figure 2:
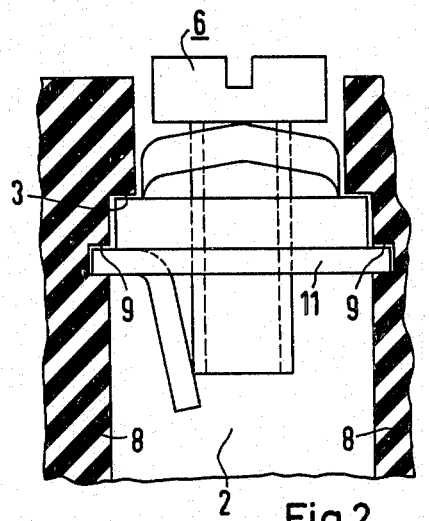
FIG. 2 is an end view of the housing shown in FIG. 1.
Figure 3:
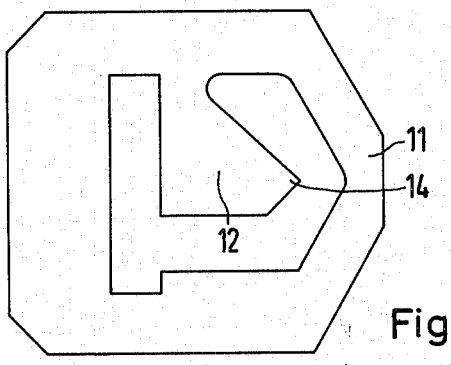
FIG. 3 is a top, plan view of an improved locking member constructed according to the invention.

Referring now to the drawings, there is shown a housing 1 of an electric switching apparatus having a cutout 2 which is open towards the bottom side thereof. The cutout includes a ledge in the form of a shoulder 3 against which a contact plate 4 is engaged in the cutout.

Contact plate 4 has a threaded tapped aperture 5 into which a screw-type electrical contact 6 is inserted. A washer 7 is disposed between contact 6 and the contact plate.

Wall parts 8 of the housing 1 have slots 9 provided therein for supporting the sides of a locking member, shown as a planar sheet member 11. The wall parts also include a slit 10 through which the planar sheet member 11 is inserted into slots 9 and into the housing 1 below contact plate 4. The assembly direction for contact plate 4 is indicated by the arrow in cutout 2, and the assembly direction for the locking member, i.e., the planar sheet member 11, is shown by the dashed arrow in slit 10 in FIG. 1. The sheet member 11 includes a projection member 12 integrally formed from the sheet member which extends in the plane of the sheet member into a recess disposed in the sheet member from one side thereof. The projection member is positioned below aperture 5 in contact plate 4 when inserted in slots 9 and slit 10 in the housing. The free end 13 of contact 6 thus engages projection member 12 as it is screwed into contact plate 4 when inserted in slots 9 and slit 10 in the housing. The free end 13 of contact 6 thus engages projection member 12 as it is screwed into contact plate 4 and the projection member is bent downwardly from the plane of the sheet member below slit 10. Point 14 of the projection member 12 is disposed so that sheet member 11 cannot be withdrawn from slit 10 and the housing.

Sheet member 11 is retained in the illustrated position even if screw contact 6 is removed from the contact plate 4 or partially disengaged from threaded aperture 5 so that free end 13 of the contact 6 is disposed within the contact plate 4 but does not protrude below the bottom surface thereof through the recess of sheet member 11. If it is necessary to remove contact plate 4, sheet member 11 can be released by bending back projection member 12 into the plane of the sheet member so that it can be slidably withdrawn from the slit 10 and the slots 9 in the housing.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. In the housing of an electric switching apparatus including a contact plate having an aperture, a screw-type electrical contact disposed in said aperture, said housing having an elongated slit disposed therein transverse with respect to the direction of insertion of said contact plate into said housing and opening into the interior of said housing adjacent said plate and said contact, and a locking member inserted through said slit into said housing for securing said contact plate therein, the improvement comprising a planar sheet member having a recess disposed therein and a projection member integrally formed from said sheet member and extending into said recess in the plane of said sheet member from one side thereof, said sheet member being supported by slots provided in said housing and said projection member being positioned below said aperture in said contact plate so that said projection member is engaged by said screw contact during insertion thereof into said contact plate and bent downwardly from the plane of said sheet member below said slot for preventing withdrawal of said sheet member from said slit and said housing.

2. The housing recited in claim 1, wherein said projection member comprises a planar stamped projection positioned in said recess of said sheet member so as to cover said aperture in said contact plate.

3. The housing recited in claim 1, further comprising a cutout disposed in said housing open from the bottom side thereof in which said contact plate and said electrical contact are disposed.

* * * * *